US007692528B2

(12) United States Patent
Nishimoto et al.

(10) Patent No.: US 7,692,528 B2
(45) Date of Patent: Apr. 6, 2010

(54) ROTARY ELECTRONIC COMPONENT

(75) Inventors: Takumi Nishimoto, Okayama (JP); Koji Ono, Okayama (JP); Jun Sato, Okayama (JP)

(73) Assignee: Panasonic Corporation, Osaka (JP)

( * ) Notice: Subject to any disclaimer, the term of this patent is extended or adjusted under 35 U.S.C. 154(b) by 601 days.

(21) Appl. No.: 11/359,828

(22) Filed: Feb. 22, 2006

(65) Prior Publication Data

US 2006/0243581 A1 Nov. 2, 2006

(30) Foreign Application Priority Data

Apr. 27, 2005 (JP) ..... 2005-129280

(51) Int. Cl.
*H01C 10/32* (2006.01)

(52) U.S. Cl. ..... 338/163; 338/162

(58) Field of Classification Search ..... 338/163
See application file for complete search history.

(56) References Cited

U.S. PATENT DOCUMENTS 4,721,939 A * 1/1988 Prestel ..... 338/162
4,891,623 A * 1/1990 Obara ..... 338/163
6,380,841 B2 * 4/2002 Masuda et al. ..... 338/163

FOREIGN PATENT DOCUMENTS

JP 2000-195375 7/2000

* cited by examiner

*Primary Examiner*—Elvin G Enad
*Assistant Examiner*—Joselito Baisa
(74) *Attorney, Agent, or Firm*—RatnerPrestia

(57) ABSTRACT

A rotary electronic component is capable of preventing misalignment of another component placed in its hollow portion and maintaining the quality of an electronic device on which to mount the rotary electronic component. The rotary electronic component has an approximately annular shape with a hollow portion. The other component placed inside the hollow portion is positioned by the positioning member formed inside the hollow portion.

8 Claims, 6 Drawing Sheets

ROTARY ELECTRONIC COMPONENT

BACKGROUND OF THE INVENTION

1. Field of the Invention

The present invention relates to a rotary electronic component having another component placed inside it.

2. Background Art

As a conventional rotary electronic component, a rotary variable resistor will be described as follows with reference to FIGS. 5 to 7. FIG. 5 is a cross sectional view of the rotary variable resistor as the conventional rotary electronic component, FIG. 6 is an exploded perspective view of the rotary electronic component, and FIG. 7 is a cross sectional view showing a mounted state of the rotary electronic component.

In FIGS. 5 and 6, rotary variable resistor 10 includes case 1 made of an insulating resin. Case 1 is approximately annular having hollow portion 1A at its center. The annular portion of case 1 forms an open-top recessed portion, and hollow portion 1A is formed by a cylindrical wall protruding upward, which is cylindrical portion 1B. The recessed portion of case 1 has approximately annular resistor 2 placed on its bottom. Resistor 2 placed inside the recessed portion of case 1 is provided on its upper surface with a predetermined resistance part and a conductive part (neither is illustrated). The resistance part and conductive part have terminals 4 at their ends for being connected with an external electric circuit. Ends of terminals 4 are led outside case 1.

Rotary variable resistor 10 further includes operation body 3 made of an insulating resin. Operation body 3 has cylindrical operation portion 3A and flange 3B formed at the bottom end of operation portion 3A. Case 1 and operation body 3 are combined with each other in such a manner that the inner surface of operation portion 3A is set outside the outer surface of cylindrical portion 1B so that cylindrical portion 1B and operation portion 3A can rotate relative to each other. The bottom surface of flange 3B of operation body 3 has brush 5 fixed thereto, which is made of elastic metal. The tip of brush 5 is in slidable contact with the resistance part and conductive part of resistor 2. Rotary variable resistor 10 further includes cover 6 made of a thin metal plate. Cover 6 has an approximately ring shape to conform to the approximate annular shape of case 1. Cover 6 is provided over the recessed portion of case 1 to keep resistor 2 and flange 3B of operation body 3 inside the recessed portion. In this condition, cylindrical portion 1B of case 1 and operation portion 3A of operation body 3 protrude upward from circular central hole 6A of cover 6.

In rotary variable resistor 10 thus structured as a conventional rotary electronic component, rotating operation portion 3A of operation body 3 makes operation body 3 rotate relative to cylindrical portion 1B of case 1. This rotation allows brush 5 on the bottom surface of flange 3B to slide in elastic contact with the resistance part and conductive part of resistor 2. As a result, a resistance value corresponding to the rotated position is obtained from terminals 4. As a typical mounted state, rotary variable resistor 10 is mounted on the wiring board of an electronic device (not illustrated) to be used, and another component is mounted in hollow portion 1A.

For example, as shown in FIG. 7, when rotary encoder 11 is combined as another component, rotary encoder 11 is positioned on wiring board 7 inside hollow portion 1A in such a manner that rotary variable resistor 10 is coaxial with the axis of the rotation of rotary encoder 11. Rotary encoder 11 includes terminal 13 which is led outside from main body 12 of rotary encoder 11 and is soldered to wiring board 7. Rotary encoder 11 also includes cylindrical bearing 14 disposed above approximately rectangular main body 12 to rotatably support operating shaft 15 protruding upward. The rotation of operating shaft 15 enables a functional component formed inside main body 12 to provide a predetermined pulse signal through terminal 13.

Operation portion 3A of operation body 3 of rotary variable resistor 10 is fitted with approximately annular outside knob 16 having a circular recess in its upper portion. On the other hand, operating shaft 15 of rotary encoder 11 is fitted with inside knob 17 having a flat circular shape in such a manner as to be positioned in the circular recess of outside knob 16. As described above, most of the conventional rotary electronic components have a coaxial double operating knob structure in which rotary variable resistor 10 is rotated by turning outside knob 16, and rotary encoder 11 is rotated by turning inside knob 17. This structure is disclosed, for example, in Japanese Patent Unexamined Publication No. 2000-195375.

However, rotary variable resistor 10, which is one of the conventional rotary electronic components, has the following disadvantage. As shown in FIG. 7, when rotary encoder 11 as another component is placed inside hollow portion LA, and outside knob 16 and inside knob 17 are fitted respectively to rotary variable resistor 10 and rotary encoder 11 to rotate them, their rotation axes are difficult to align with each other, and are sometimes misaligned.

To overcome this disadvantage, when the coaxial double operating knobs, that is, outside knob 16 and inside knob 17 are used, it is necessary to absorb the misalignment by providing a large clearance between outside knob 16 and inside knob 17. This may decrease the quality of the electronic device on which rotary variable resistor 10 with rotary encoder 11 is mounted.

SUMMARY OF THE INVENTION

The present invention provides a rotary electronic component which prevents misalignment of another component placed in its hollow portion, thereby maintaining the quality of the electronic device on which to mount the rotary electronic component.

The rotary electronic component of the present invention comprises: a rotary electronic component main body having an approximately annular shape with a hollow portion; and an electronic component functional device formed in the rotary electronic component main body, wherein the rotary electronic component main body has a positioning member in the hollow portion, and the positioning member positions another component placed inside the hollow portion. In this structure, the positioning member inside the hollow portion prevents misalignment of the other component placed in the hollow portion.

In the rotary electronic component of the present invention, the rotary electronic component main body may comprise: a first housing made of an insulating resin and having a first cylindrical portion; and a second housing made of an insulating resin and having a second cylindrical portion coaxially positioned outside the first cylindrical portion, the first housing may be engaged with the second housing in such a manner that the first cylindrical portion and the second cylindrical portion can rotate relative to each other; the first cylindrical portion may have an inward protrusion formed integrally and protrudes from an inner surface of the first cylindrical portion inwardly into the hollow portion; and the inward protrusion may be the positioning member. In this structure, the integral formation of the inward protrusion as the positioning member on the inner surface of the first cylindrical portion facilitates the positioning of the other component placed inside the hollow portion, without increasing the number of component elements.

In the rotary electronic component of the present invention, the inward protrusion may include penetrated space which penetrates through a wall of the inward protrusion, and the other component placed on one side of the wall of the inward protrusion may have an operation portion protruding rotatably into the other side of the wall of the inward protrusion via the space. This structure enables the rotary component placed inside the hollow portion to be positioned in a rotatable state.

In the rotary electronic component of the present invention, the inward protrusion may include penetrated space which penetrates through a wall of the inward protrusion, and the other component placed on one side of the wall of the inward protrusion may have an operation portion protruding slidably into the other side of the wall of the inward protrusion via the space. This structure enables the sliding component placed inside the hollow portion to be positioned in a slidable state.

In the rotary electronic component of the present invention, the inward protrusion may include penetrated space which penetrates through a wall of the inward protrusion, and the other component placed on one side of the wall of the inward protrusion may have an operation portion protruding pushably into the other side of the wall of the inward protrusion via the space. This structure enables the pushable component placed inside the hollow portion to be positioned in a pushable state.

In the rotary electronic component of the present invention, the inward protrusion may include penetrated space which penetrates through a wall of the inward protrusion, and the other component placed on one side of the wall of the inward protrusion may have an operation portion protruding pullably into the other side of the wall of the inward protrusion via the space. This structure enables the pullable component placed inside the hollow portion to be positioned in a pullable state.

In the rotary electronic component of the present invention, the inward protrusion may have a support member for supporting the other component. In this structure, the support member supports the other component placed inside the hollow portion against weight applied during operation such as rotation or sliding, thereby maintaining the other component in a fixed state. As a result, the other component provides smooth and stable operation.

DETAILED DESCRIPTION OF THE INVENTION

Figure 1:
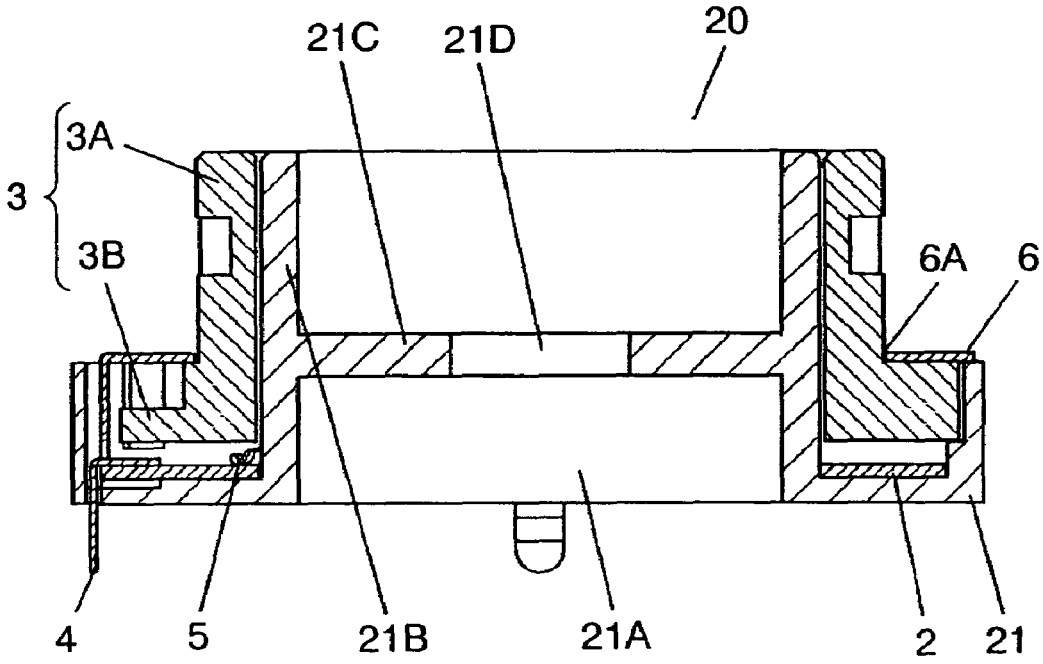
FIG. 1 is a cross sectional view of a rotary variable resistor, which is a rotary electronic component according to an embodiment of the present invention.

An embodiment of the present invention will be described as follows with reference to accompanying drawings. The same component elements as those described in Background Art above will be referred to with the same reference numerals, and will be described in a simplified manner.

Embodiment

Figure 2:
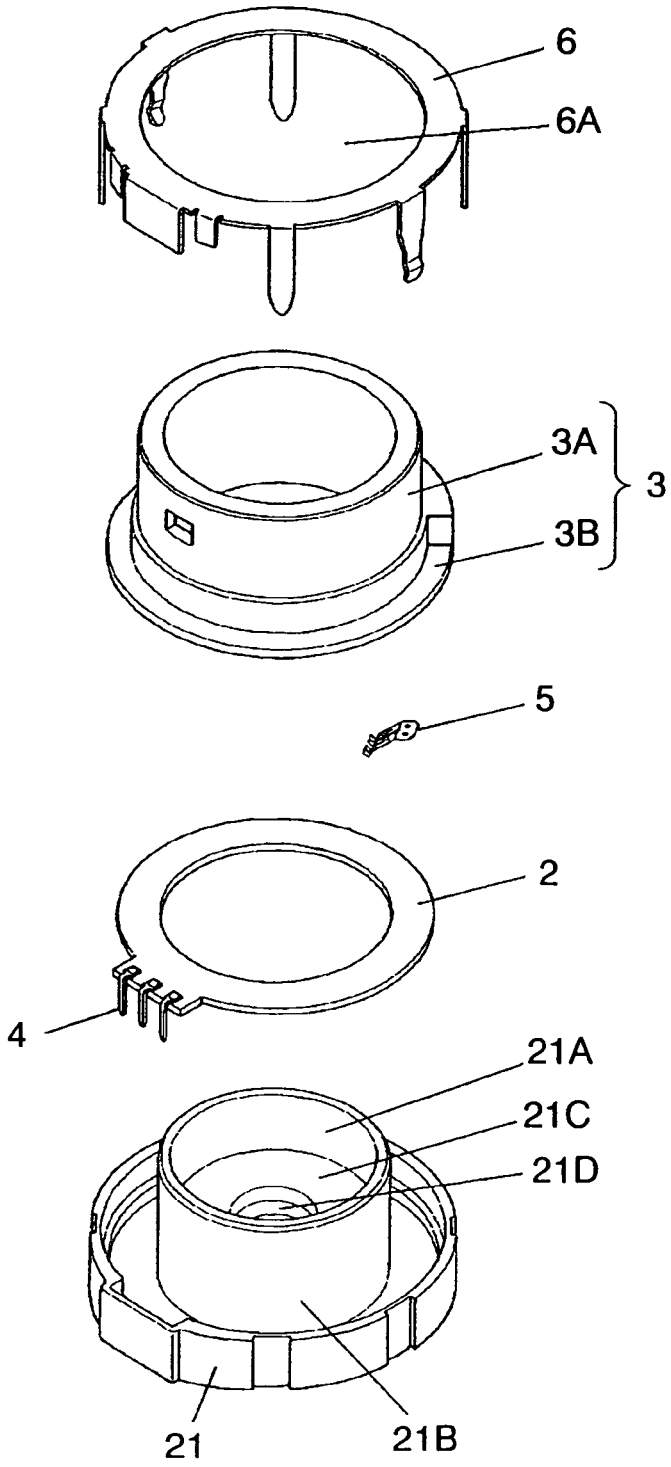
FIG. 2 is an exploded perspective view of the rotary electronic component of according to the embodiment.
Figure 3:
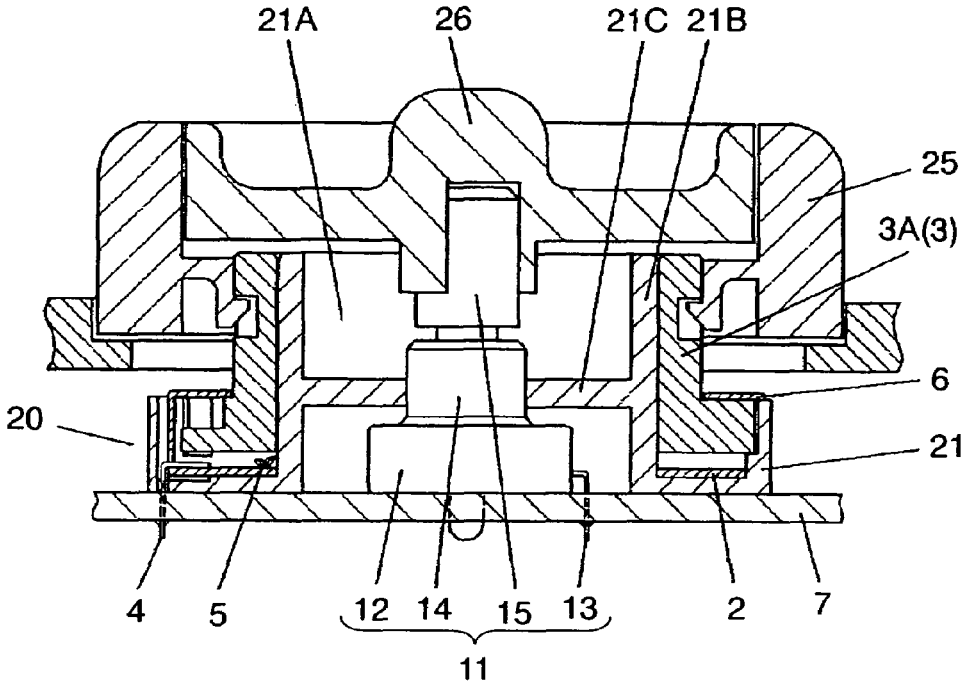
FIG. 3 is a cross sectional view showing a mounted state of the rotary electronic component according to the embodiment.

FIG. 1 is a cross sectional view of a rotary variable resistor, which is a rotary electronic component of an embodiment of the present invention. FIG. 2 is an exploded perspective view of the rotary electronic component of the embodiment. FIG. 3 is a cross sectional view showing a mounted state of the rotary electronic component of the embodiment.

In FIGS. 1 and 2, rotary variable resistor 20 includes case 21 as a first housing, which is made of an insulating resin. Case 21 is approximately annular having hollow portion 21A at its center. The annular portion of case 21 forms an open-top recessed portion, and hollow portion 21A is formed by a cylindrical wall protruding upward, which is cylindrical portion 21B as a first cylindrical portion. The recessed portion of case 21 has approximately annular resistor 2 placed on its bottom. Resistor 2 placed inside the recessed portion of case 21 is provided on its upper surface with a resistance part and a conductive part (neither is illustrated). The resistance part and conductive part have terminals 4 at their ends. Terminals 4 are led outside case 21.

Rotary variable resistor 20 further includes operation body 3 as a second housing, which is made of an insulating resin. Operation body 3 has operation portion 3A as a second cylindrical portion and flange 3B formed at the bottom end of operation portion 3A. Case 21 and operation body 3 are combined with each other in such a manner that the inner surface of operation portion 3A is set outside the outer surface of cylindrical portion 21B so that cylindrical portion 21B and operation portion 3A can rotate relative to each other. The bottom surface of flange 3B has brush 5 fixed thereto, which is made of elastic metal. The tip of brush 5 is in slidable contact with the resistance part and conductive part of resistor 2. Rotary variable resistor 20 further includes cover 6 made of a thin metal plate. Cover 6 is provided over the recessed portion of case 21 to keep resistor 2 and flange 3B of operation body 3 inside the recessed portion and also to make cylindrical portion 21B of case 21 and operation portion 3A of operation body 3 protrude upward from central hole 6A. The rotary electronic component main body includes the first cylindrical portion, the second cylindrical portion, while the electronic component functional device includes resistor 2, terminals 4 and brush 5.

Rotary variable resistor 20 of the present embodiment further includes inward protrusion 21C as a positioning member, which is integrally made of the same insulating resin as case 21. Inward protrusion 21C has a predetermined thickness and protrudes from the inner surface of cylindrical portion 21B forming hollow portion 21A of case 21 toward the center of hollow portion 21A at about the middle height of cylindrical portion 21B. Inward protrusion 21C includes penetrated space 21D at its center, which vertically penetrates through inward protrusion 21C. Penetrated space 21D has a size and shape that fits rotary encoder 11 described later, and is vertically coaxial with cylindrical portion 21B.

In rotary variable resistor 20 thus structured as a rotary electronic component, rotating operation portion 3A of operation body 3 makes operation body 3 rotate relative to cylindrical portion 21B of case 21. This rotation allows brush 5 on the bottom surface of flange 3B to slide in elastic contact with the resistance part and conductive part of resistor 2. As a result, a resistance value corresponding to the rotated position is obtained from terminals 4.

As a mounted state, as shown in FIG. 3, rotary variable resistor 20 is mounted on wiring board 7 of an electronic device (not illustrated), with terminals 4 fixedly soldered to wiring board 7. Rotary encoder 11 as another component is mounted wiring board 7 inside hollow portion 21A, with terminal 13 fixedly soldered to wiring board 7. Rotary encoder 11, which is identical to the one described in Background Art, includes cylindrical bearing 14 disposed above approximately rectangular main body 12 to rotatably support operating shaft 15 protruding upward. The rotation of operating shaft 15 enables the functional component formed inside main body 12 to provide a predetermined pulse signal through terminal 13.

Operation portion 3A of operation body 3 of rotary variable resistor 20 is fitted with approximately annular outside knob 25 having a circular recess in its upper portion. On the other hand, operating shaft 15 of rotary encoder 11 is fitted with inside knob 26 having a flat circular shape. Inside knob 26 is fitted into the circular recess of outside knob 25 to form coaxial double operating knobs so that outside knob 25 and inside knob 26 can be rotated individually.

Turning outside knob 25 allows a desired resistance value from rotary variable resistor 20 in accordance with the turned position to be outputted to an electric circuit (not illustrated) of the electronic device connected to terminals 4. Turning inside knob 26 allows a desired pulse signal from rotary encoder 11 to be outputted to the electric circuit of the electronic device connected to terminal 13.

As described hereinbefore, rotary variable resistor 20, which is the rotary electronic component of the present embodiment can mount rotary encoder 11 as another component with little misalignment. This is because inward protrusion 21C provided on the inner surface of cylindrical portion 21B of rotary variable resistor 20 restricts the position of bearing 14 of rotary encoder 11 so that operating shaft 15 of rotary encoder 11 can be positioned coaxially with the rotation axis of rotary variable resistor 20. Penetrated space 21D of inward protrusion 21C also allows operating shaft 15 of rotary encoder 11 to protrude above inward protrusion 21C, thereby enabling the rotation of operating shaft 15 without hindrance.

The integral formation of inward protrusion 21C on the inner surface of cylindrical portion 21B facilitates the positioning of rotary encoder 11 inside hollow portion 21A as described above without increasing the number of component elements. Penetrated space 21D of inward protrusion 21C formed in hollow portion 21A of rotary variable resistor 20 is circular-shaped to conform to the cylindrical shape of bearing 14, thereby supporting rotary encoder 11 in the horizontal direction. Thus, penetrated space 21D also serves as a support member to support rotary encoder 11 against weight applied in the horizontal direction during the rotation of rotary encoder 11, thereby easily achieving the smooth and secure rotation.

When the double operation knobs having outside knob 25 and inside knob 26 shown in FIG. 3 is used, inward protrusion 21C formed in hollow portion 21A of rotary variable resistor 20 positions and supports rotary encoder 11. As a result, rotary encoder 11 is prevented from being misaligned and is supported against the weight applied in the horizontal direction during the rotation of rotary encoder 11. This allows a reduced clearance between outside and inside knobs 25, 26 to avoid contact therebetween, thereby improving the quality of the electronic device to be used.

The operation portion of the other component is rotatable in the embodiment; however, the present invention can be implemented when the operation portion is pushable or pullable. When a pushable component is used as rotary encoder 11 in FIG. 3, inside knob 26 is fitted by providing a clearance for pushing operation. When a pullable component is used as rotary encoder 11, inside knob 26 can be shaped to allow the user to pull it. The other aspects are similar to the embodiment, so the description will be omitted.

Figure 4:
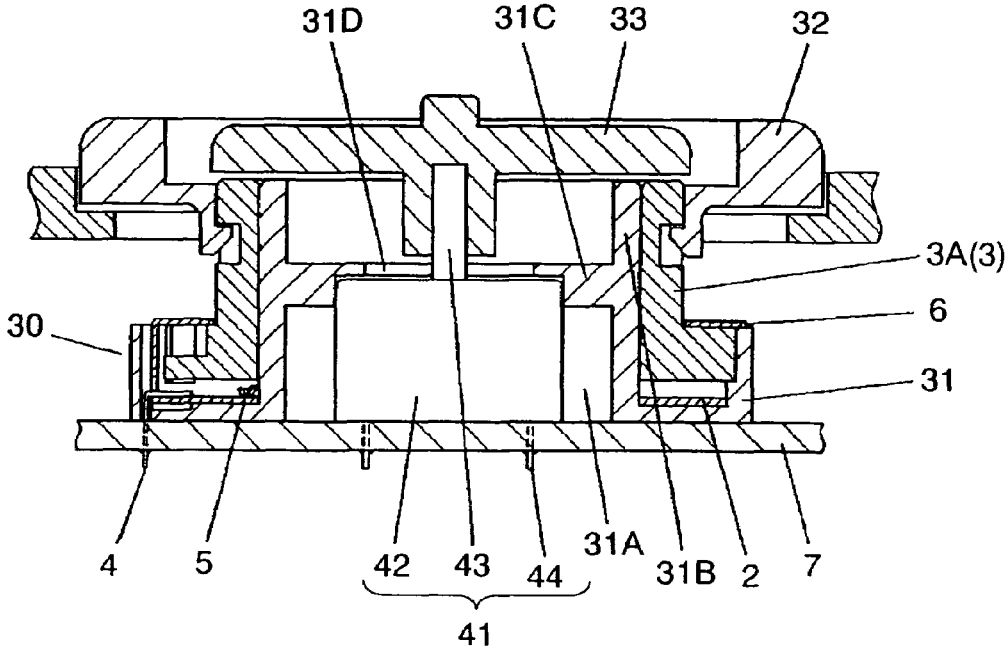
FIG. 4 is a cross sectional view showing a mounted state of the rotary electronic component according to the embodiment.
Figure 5:
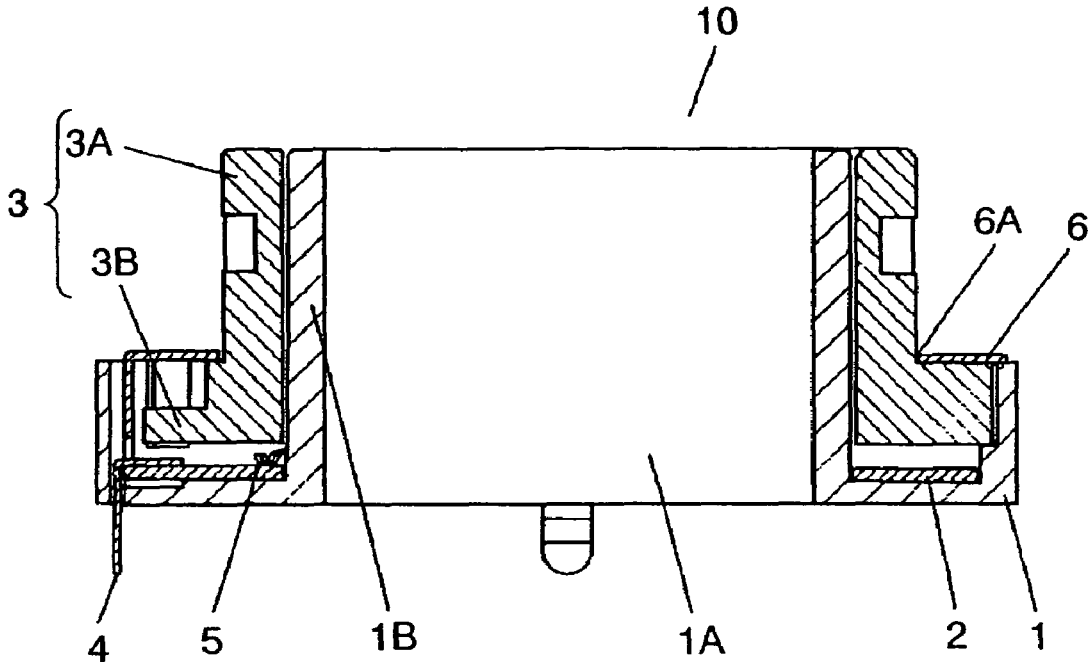
FIG. 5 PRIOR ART
FIG. 5 is a cross sectional view of a conventional rotary electronic component.
Figure 6:
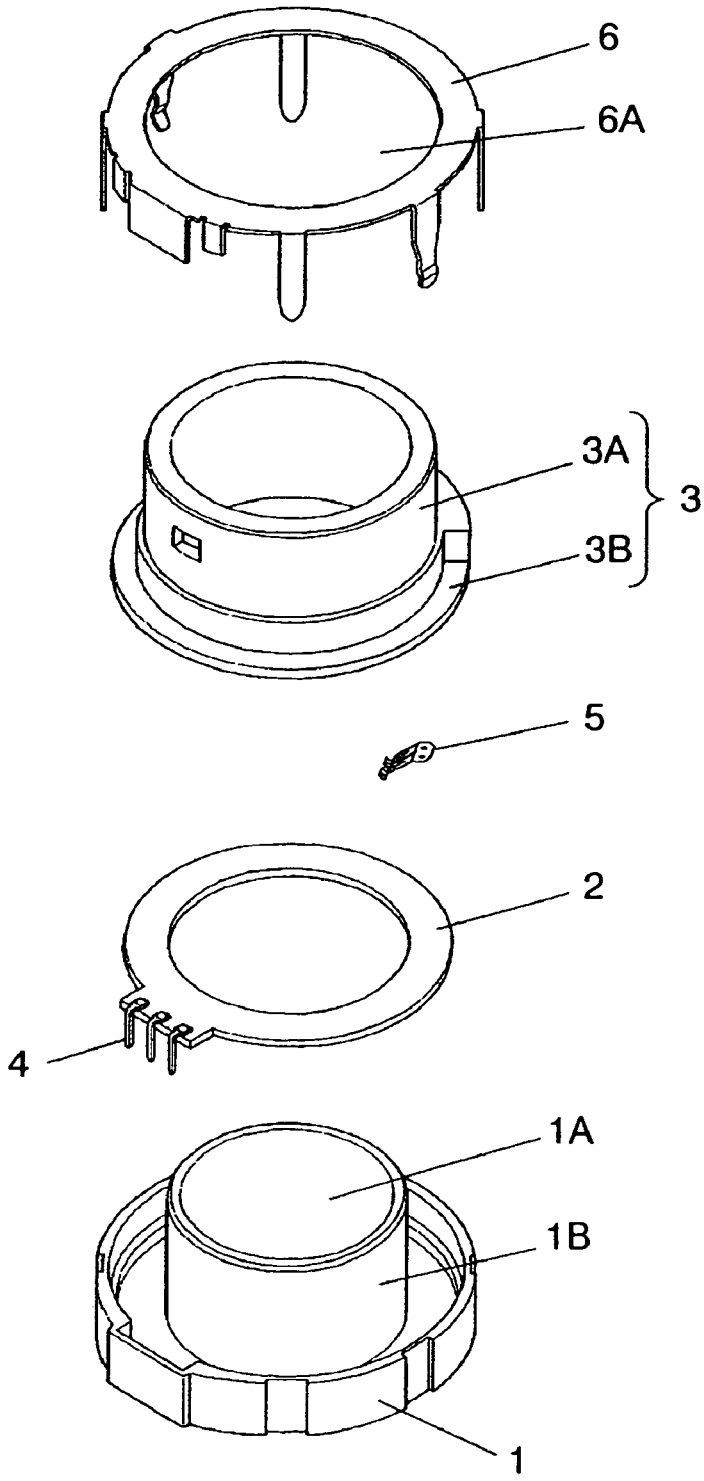
FIG. 6 PRIOR ART
FIG. 6 is an exploded perspective view of the conventional rotary electronic component.
Figure 7:
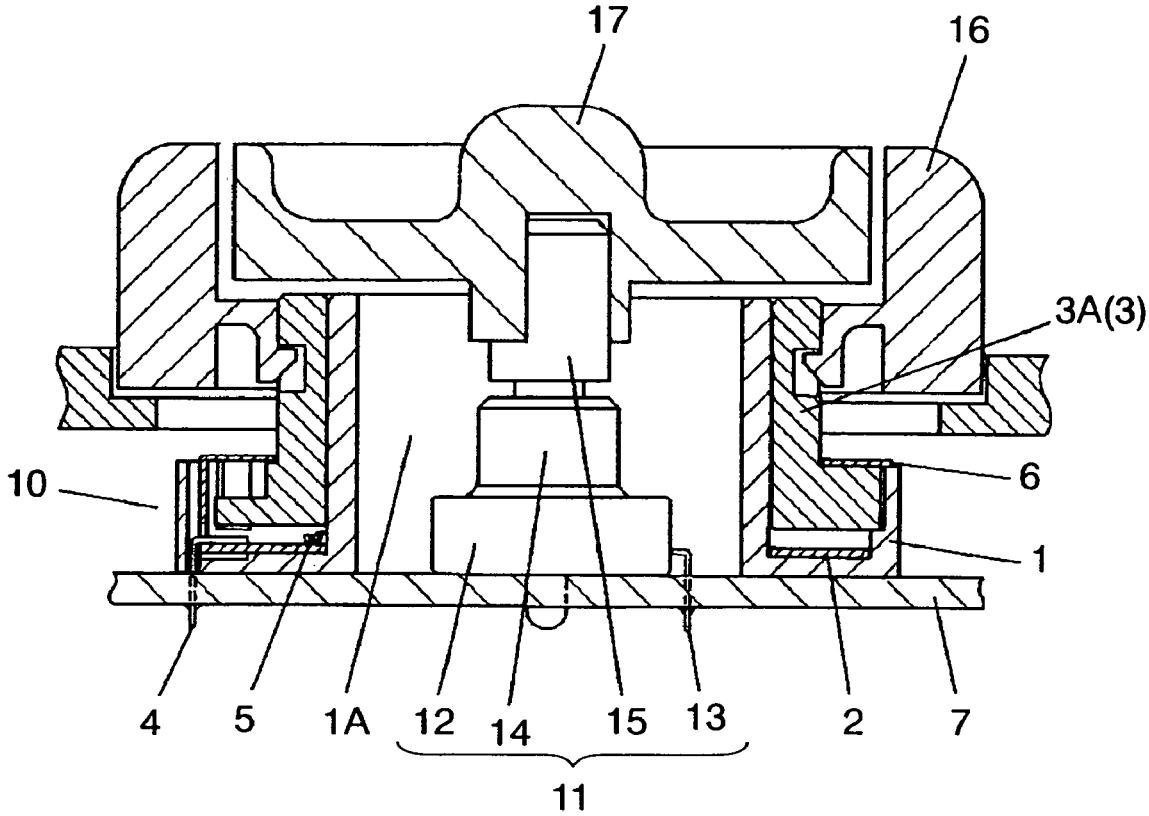
FIG. 7 PRIOR ART
FIG. 7 is a cross sectional view showing a mounted state of the conventional rotary electronic component.

As shown in FIG. 4, the other component placed in hollow portion 21A can be a sliding electronic component. In FIG. 4, rotary variable resistor 30 is approximately annular with hollow portion 31A. Sliding switch 41 is a sliding electronic component. Operation portion 3A of rotary variable resistor 30 is fitted with outside knob 32, and operating lever 43 of sliding switch 41 protruding upward is fitted with inside knob 33. Terminals 4 of rotary variable resistor 30 and terminal 44 of sliding switch 41 are soldered to wiring board 7.

Rotary variable resistor 30 includes inward protrusion 31C which protrudes from the inner surface of cylindrical portion 31B forming hollow portion 31A of case 31 toward the center of hollow portion 31A at about the middle height of cylindrical portion 31B. Inward protrusion 31C includes penetrated space 31D at its center, which vertically penetrates through inward protrusion 31C and is long and narrow in the horizontal direction, i.e. in the direction to slide sliding switch 41. Penetrated space 31D is a little longer than the sliding range of operating lever 43 so as to allow operating lever 43 of sliding switch 41 to protrude upward through it. Penetrated space 31D has a step and is larger in length under the step, and the inner end surface under the step is in support contact with the side surface of approximately rectangular solid main body 42 of sliding switch 41.

Sliding inside knob 33 in the crosswise direction in FIG. 4, which corresponds to the direction to slide sliding switch 41 provides a switch signal from the functional component (not illustrated) inside main body 42 of sliding switch 41 through terminal 44. The switch signal is outputted to the electric circuit of the electronic device connected with terminal 44. The operation of rotary variable resistor 30 will be omitted because it is identical to that mentioned above.

Main body 42 of sliding switch 41 is supported at the side surface by the inner end surface of penetrated space 31D under the step, and is position-controlled in the upward direction at the portion higher than the step. As a result, inward protrusion 31C including penetrated space 31D serves as a support member against weight applied due to sliding operation. During the sliding operation, sliding switch 41 is maintained in a fixed state, providing smooth and secure operability. This operability can be further improved by setting the width of operating lever 43 so that operating lever 43 can be guided in the direction of operation by the long and narrow hole above the step of penetrated space 31D through which operating lever 43 protrudes upward.

Inward protrusions 21C and 31C to support other components 11 and 41 placed respectively inside hollow portions 21A and 31A can be provided anywhere as long as other components 11 and 41 are fixed. However, considering the moment relative to the weight applied during the operation, inward protrusions 21C and 31C are preferably located far from the positions where other components 11 and 41 are soldered to wiring board 7.

Note that the embodiment uses rotary variable resistors 20 and 30 as the rotary electronic component; however, the present invention is not limited to these and can be applied to all kinds of rotary electronic components having a hollow portion such as rotary encoders and rotary switches. Similarly, the other components placed inside hollow portions 21A and 31A are not limited to those described in the embodiment, and can be other electronic components, or non-electronic components such as functional and optical components.

Although it is preferable to make inward protrusions 21C and 31C integral with cases 21 and 31 respectively because it can improve positioning precision with a reduced number of component elements, it is alternatively possible to provide a separate positioning member inside the hollow portion. Furthermore, penetrated spaces 21D and 31D formed in inward protrusions 21C and 31C respectively also serve as a support member; however, the support member may have a different structure.

As described above, the rotary electronic component of the present invention can position another component placed inside the hollow portion by using the positioning member formed inside the hollow portion. As a result, the other component can be prevented from being misaligned, thereby maintaining the quality of the electronic device on which to mount the rotary electronic component. Thus, this is useful as a rotary electronic component which is an operation unit of various electronic devices and has another component therein.

What is claimed is:

1. A rotary electronic component comprising:

a rotary electronic component main body having an approximately ring-like shape and a hollow interior, the rotary electronic component main body including a positioning member which extends from an interior wall of the main body and towards the center of the hollow interior;

an internal electrical component which is situated in the hollow interior; and wherein an external electrical component which is situated outside of the hollow interior, wherein a portion of the external electrical component rotates with the main body, the positioning member is in contact with a periphery of the internal electrical component, the positioning member extends from the interior wall partway between a top end and a bottom end of the main body so that a) a first hollow region of the hollow interior is situated below the positioning member and is occupied by a portion of the internal electrical component and b) a second hollow region of the hollow interior is situated above the positioning member and is occupied by a further portion of the internal electrical component wherein the external electrical component rotates independently of the internal electrical component.

2. The rotary electronic component of claim 1, wherein the rotary electronic component main body comprises:

a first housing made of an insulating resin and having a first cylindrical portion; and a second housing made of an insulating resin and having a second cylindrical portion coaxially positioned outside the first cylindrical portion, the first housing is engaged with the second housing in such a manner that the first cylindrical portion and the second cylindrical portion can rotate relative to each other;

the first cylindrical portion has an inward protrusion formed integrally and protrudes from an inner surface of the first cylindrical portion inwardly into the hollow portion; and the inward protrusion is the positioning member.

3. The rotary electronic component of claim 2, wherein the inward protrusion includes penetrated space which penetrates through a wall of the inward protrusion, and the further electrical component placed on one side of the wall of the inward protrusion has an operation portion protruding rotatably into an other side of the wall of the inward protrusion via the space.

4. The rotary electronic component of claim 2, wherein the inward protrusion includes penetrated space which penetrates through a wall of the inward protrusion, and the further electrical component placed on one side of the wall of the inward protrusion has an operation portion protruding slidably into an other side of the wall of the inward protrusion via the space.

5. The rotary electronic component of claim 2, wherein the inward protrusion includes penetrated space which penetrates through a wall of the inward protrusion, and the further electrical component placed on one side of the wall of the inward protrusion has an operation portion protruding pushably into an other side of the wall of the inward protrusion via the space.

6. The rotary electronic component of claim 2, wherein the inward protrusion includes penetrated space which penetrates through a wall of the inward protrusion, and the further electrical component placed on one side of the wall of the inward protrusion has an operation portion protruding pullably into an other side of the wall of the inward protrusion via the space.

7. The rotary electronic component of claim 2, wherein the inward protrusion has a support member for supporting the further electrical component.

8. The rotary electronic component of claim 1, wherein the positioning member projects inward from the hollow portion to contact the periphery of the further electrical component along a portion of a length of the further electrical component and the hollow portion and the further electrical component form gaps at other portions along the length of the further electrical component inside the hollow portion.

* * * * *